US006583392B2

(12) United States Patent
Hershey et al.

(10) Patent No.: US 6,583,392 B2
(45) Date of Patent: Jun. 24, 2003

(54) APPARATUS AND METHOD FOR DETERMINING PROPERTIES OF A COOKTOP USING ULTRASOUND TECHNIQUES

(75) Inventors: John Erik Hershey, Ballston Lake, NY (US); Richard Yung Chiao, Menomonee Falls, WI (US); Ralph Thomas Hoctor, Saratoga Springs, NY (US)

(73) Assignee: General Electric Company, Niskayuna, NY (US)

( * ) Notice: Subject to any disclaimer, the term of this patent is extended or adjusted under 35 U.S.C. 154(b) by 153 days.

(21) Appl. No.: 09/746,621

(22) Filed: Dec. 22, 2000

(65) Prior Publication Data

US 2002/0078942 A1 Jun. 27, 2002

(51) Int. Cl.[7] ..... H05B 1/02

(52) U.S. Cl. ..... 219/518; 219/413; 219/706; 219/446.1

(58) Field of Search ..... 219/518, 497, 219/502, 706, 447.1, 446.1, 620–624

(56) References Cited

U.S. PATENT DOCUMENTS 4,868,357 A * 9/1989 Serikawa et al. ..... 219/10.55 B
5,951,900 A * 9/1999 Smrke ..... 219/497
6,259,069 B1 * 7/2001 Schotten et al. ..... 219/447.1

FOREIGN PATENT DOCUMENTS

DE 3934157 * 4/1991

* cited by examiner

*Primary Examiner*—Mark Paschall
(74) *Attorney, Agent, or Firm*—John F. Thompson; Patrick K. Patnode

(57) ABSTRACT

An apparatus for determining at least one property of a cooktop is provided. The cooktop includes a cooktop surface and a vessel selectively positioned on the cooktop surface. The apparatus comprises an ultrasound transducer contacting the cooktop surface. The ultrasound transducer includes an ultrasound transmitter that contacts the cooktop surface and provides an ultrasound waveform to the cooktop surface creating an excitation in the cooktop surface. The ultrasonic transducer also includes an ultrasound receiver contacting the cooktop surface. The ultrasound receiver receives a resultant ultrasound waveform in response to the excitation and produces a receiver output signal in response to the resultant ultrasound waveform. A processor is connected to the ultrasound transducer. The processor receives the receiver output signal and produces a processor output signal corresponding to the at least one property of the cooktop.

30 Claims, 4 Drawing Sheets

APPARATUS AND METHOD FOR DETERMINING PROPERTIES OF A COOKTOP USING ULTRASOUND TECHNIQUES

BACKGROUND OF THE INVENTION

The present invention relates generally to the determination of properties of a cooktop, and, more particularly, to a method and apparatus for method for determining properties of a cooktop by providing an ultrasound waveform to the cooktop surface and measuring a resultant ultrasound waveform.

In some conventional cooktops and ranges, standard porcelain enamel cooktop surfaces have been replaced by smooth, continuous-surface, high-resistivity cooktops located above one or more heating elements, such as electrical heating elements or gas burners. The smooth, continuous-surface cooktops are easier to clean because they do not have seams or recesses in which debris can accumulate. The continuous cooktop surface also prevents spillovers from coming into contact with the heating elements or burners.

Some conventional cooktops and/or ranges can detect properties of the cooktop, vessel or cooking process via devices that provide contact with a cooking vessel disposed on an electric heating element or on the cooking vessel support of a gas burner. Such contact-based systems, however, have not proven to be feasible for continuous-surface cooktops, and especially glass-ceramic cooktops due to the difficulties of placing contact sensors thereon. Cooking vessel contact sensors generally disrupt the continuous cooktop appearance, weaken the structural rigidity of the cooktop, and increase manufacturing costs. Also, such contact-based systems are not inherently reliable on smooth-surface cooktops because cooking vessel with warped or uneven bottoms may exert varying forces on the contact sensors and give a false contact indication.

In other conventional cooktops or ranges, the reflective properties of a cooking vessel positioned on the surface of the cooktop are used to determine properties of the cooktop, vessel or cooking process. However, the reflective properties vary between vessels. In addition, with age and usage of the vessel, the reflective properties of the vessel can diminish due to for example corrosion, staining and burned on coatings. Thus, the use of vessel reflective properties to determine the properties the cooktop, vessel or cooking process may, at times, be unreliable or inconsistent.

Therefore, it is desirable to provide a system that detects properties of the cooktop without compromising the structural integrity of the cooktop surface. In addition, it is also desirable to provide a system for detecting properties of a cooktop that is independent of cooking vessel composition, flatness of the bottom of the cooking vessel, or weight of the cooking vessel. Additionally, it is desired to have a cooktop and/or range that uses a system that detects properties of a cooktop independent of the reflective properties of the cooking vessel when determining properties of the cooktop, cooking vessel or cooking process.

BRIEF SUMMARY OF THE INVENTION

In one representative embodiment, an apparatus for determining at least one property of a cooktop is provided. The cooktop includes a cooktop surface and a vessel selectively positioned on the cooktop surface. The apparatus comprises an ultrasound transducer contacting the cooktop surface.

The ultrasound transducer includes an ultrasound transmitter that contacts the cooktop surface and provides an ultrasound waveform to the cooktop surface creating an excitation in the cooktop surface. The ultrasonic transducer also includes an ultrasound receiver contacting the cooktop surface. The ultrasound receiver receives a resultant ultrasound waveform in response to the excitation and produces a receiver output signal in response to the resultant ultrasound waveform. A processor is connected to the ultrasound transducer. The processor receives the receiver output signal and produces a processor output signal corresponding to the at least one property of the cooktop.

In another representative embodiment, an apparatus for determining at least one property of a cooktop is provided. The cooktop has a cooktop surface with a top and bottom and a vessel selectively positioned on the top of the cooktop surface. The apparatus includes an ultrasound transmitter that contacts the bottom of the cooktop surface at a first position. The ultrasonic transmitter transmits an ultrasound waveform within the cooktop surface creating an excitation in the cooktop surface. An ultrasound receiver also contacts the bottom of the cooktop surface at a second position, and the first position is different from the second position. The ultrasound receiver receives a resultant ultrasound waveform in response to the ultrasound waveform produced by the ultrasound transmitter, and the ultrasound receiver produces a receiver output signal based on the resultant ultrasound waveform. A processor is connected to the ultrasound receiver for receiving the receiver output signal. The processor produces a processor output signal in response to the receiver output signal, the processor output signal being indicative of the at least one property of the cooktop.

In even another representative embodiment, a method for determining at least one property of a cooktop is provided. The cooktop has a cooktop surface and a vessel selectively positioned on the cooktop surface. The method includes the steps of contacting a transducer to the cooktop surface. An ultrasound waveform is provided to the cooktop surface from a transmitter of the transducer. An excitation is created in the cooktop surface from the provided ultrasound waveform. A resultant ultrasound waveform is received using a receiver of the transducer. The resultant ultrasound waveform is in response to the excitation produced by the ultrasound waveform. A receiver output signal is produced in response to the resultant ultrasound waveform. A processor output signal is determined based on the receiver output. The processor output signal corresponds to the at least one property of the cooktop.

DETAILED DESCRIPTION OF THE INVENTION

Figure 1:
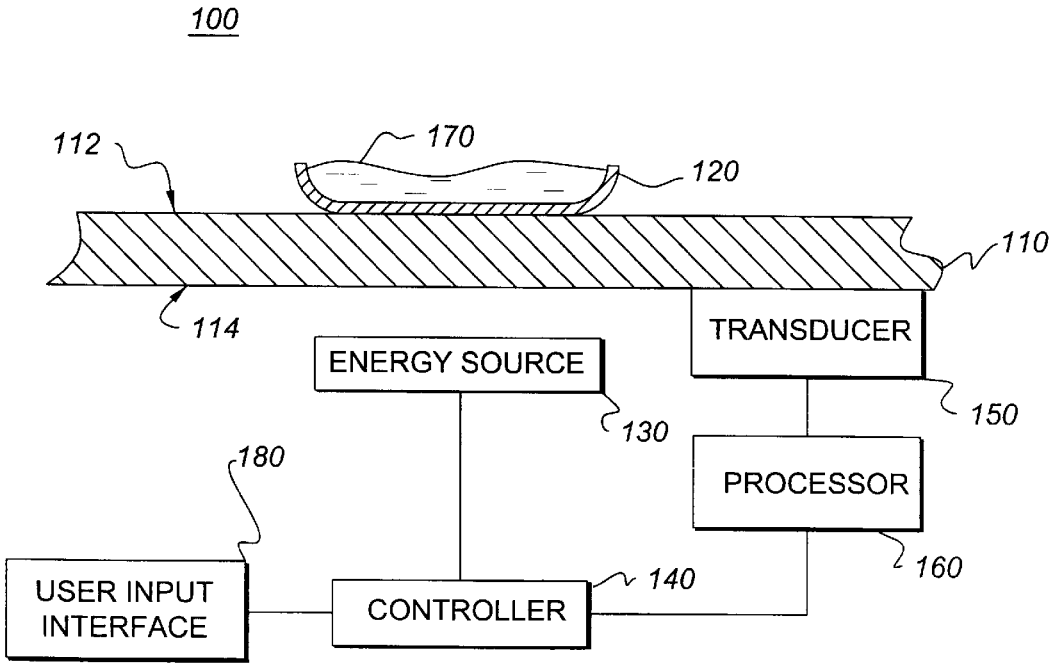
FIG. 1 is a cross-sectional and block diagram view of one exemplary embodiment of the present invention.
Figure 2:
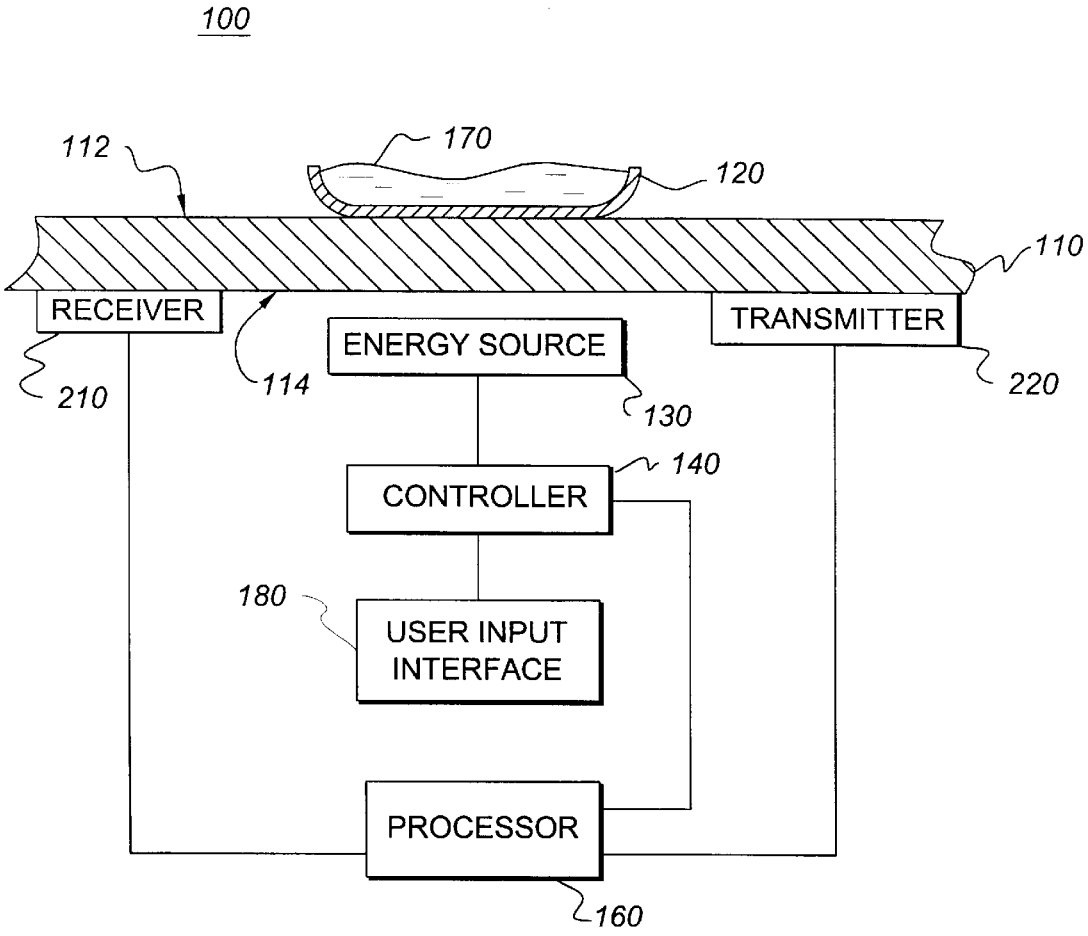
FIG. 2 is a cross-sectional and block diagram view of another exemplary embodiment of the present invention.
Figure 3:
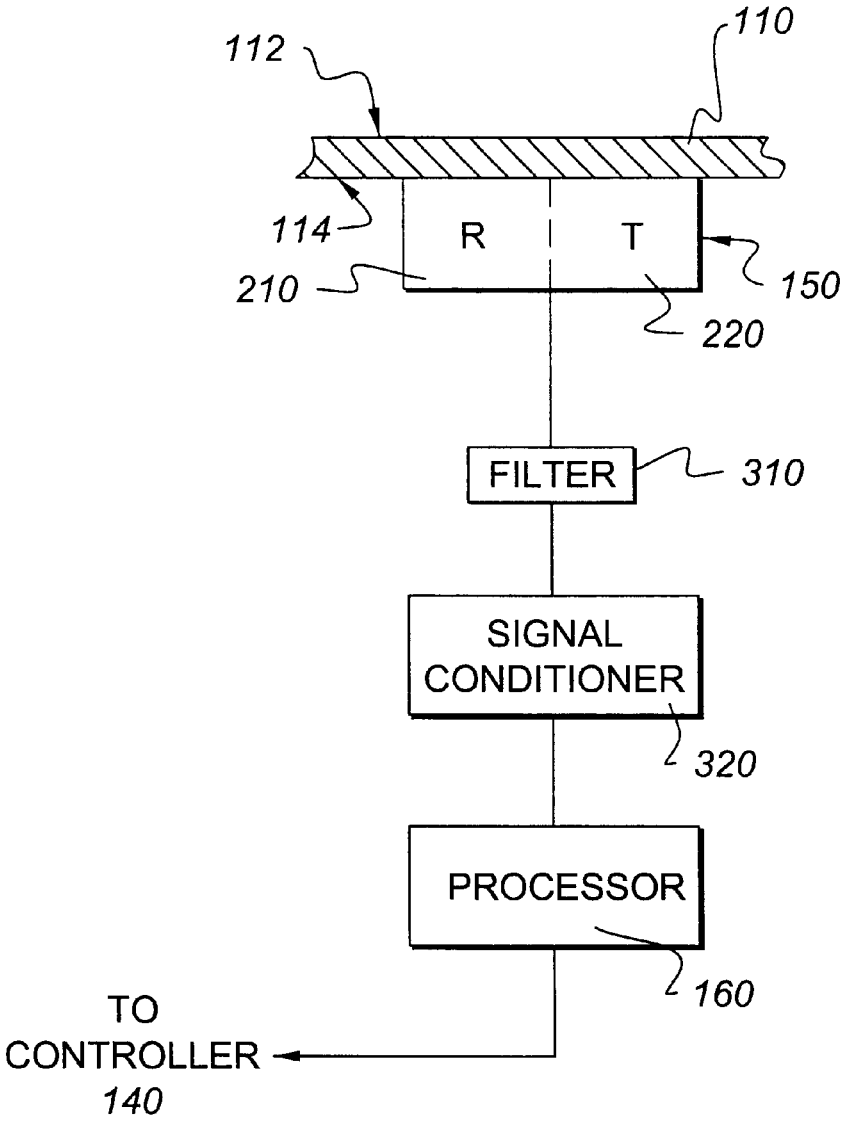
FIG. 3 is a cross-sectional of a cooktop surface and block diagram view of one exemplary embodiment of electronic circuitry connected to an ultrasound transducer.

As shown in FIGS. 1–3, an ultrasound transducer 150 including an ultrasound transmitter 220 and an ultrasound receiver 210 contacts a cooktop surface 110. The ultrasound transmitter 220 transmits an ultrasound waveform to the cooktop surface 110. The ultrasound waveform provides an excitation in the cooktop surface 110 that produces a resultant ultrasound waveform. The ultrasound receiver 210 receives the resultant ultrasound waveform which is provided to a processor 160 that produces a processor output signal that corresponds to at least one property of the cooktop 100.

In FIGS. 1 and 2, a cooktop 100 includes a cooktop surface 110 having a top 112 and a bottom 114. The cooktop surface 110 can be composed of, for example, any suitable solid material, such as glass-ceramic. In one embodiment, a energy source 130 is positioned below the cooktop surface 110. The energy source 130 can comprise, for example, any suitable energy source, such as radiant heating sources, electric or gas heating elements or induction heating sources. A user can selectively place a vessel 120, such as a pot and/or pan, on the cooktop 110. The vessel 120 contains contents 170 that can be heated by the energy source 130. A controller 120 is connected to the energy source 112 and controls the amount of heat produced by the energy source 130. A user input interface 180 is connected to the controller 140 to allow a user to select the level of energy supplied to the energy source 130, and therefore, the heat supplied to the vessel 120.

Also shown in FIGS. 1 and 2, an ultrasound transducer 150 contacts the cooktop surface 110. It should be appreciated that, in one embodiment, the acoustic transducer 150 can contact the bottom 114 of the cooktop surface 110. In another embodiment, the ultrasound transducer 150 can be connected to the cooktop surface 110 by an acoustically transmissive adhesive. In even another embodiment, the ultrasound transducer 150 can be formed, for example, within, integral with, or as part of the cooktop surface 110. The ultrasound transducer 150 is connected to a processor 160 that is connected to the controller 140. In one embodiment shown in FIGS. 1 and 3, the ultrasound transducer 150 houses an ultrasound transmitter 220 and an ultrasound receiver 210. In this embodiment, the ultrasound transmitter 220 and the ultrasound receiver 210 contact the cooktop surface 110 at a first position. In another embodiment shown in FIG. 2, the ultrasound transmitter 220 and the ultrasound receiver 210 are separately housed units. In this embodiment, the ultrasound transmitter 220 contacts the cooking surface 110 at a first position, and the ultrasound receiver 210 contacts the cooking surface at a second position, and the first position is different from the second position. As shown in FIG. 2, the ultrasound transmitter 220 and the ultrasound receiver 210 are connected to the processor 160 that is connected to the controller 140.

Figure 4:
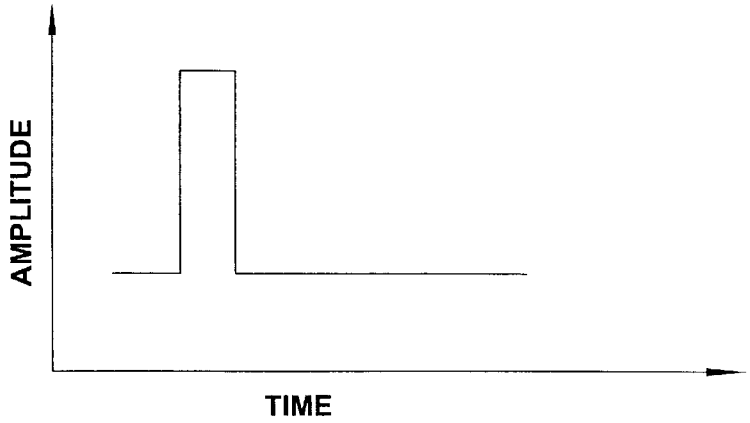
FIG. 4 is a graphical representation of an exemplary embodiment of an ultrasound waveform produced by an ultrasound transmitter.
Figure 5:
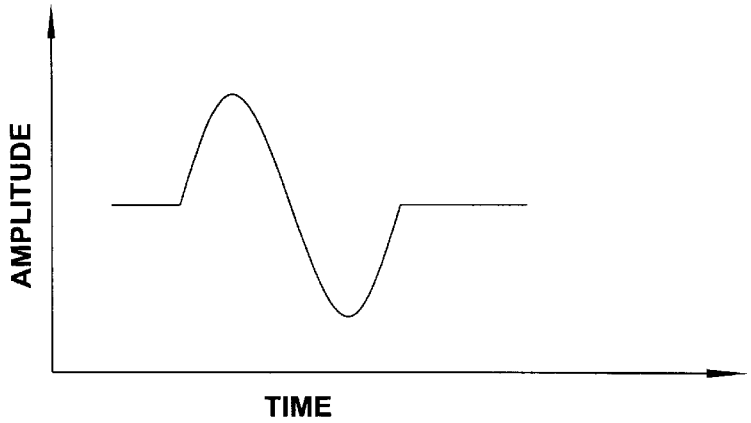
FIG. 5 is a graphical representation of another exemplary embodiment of an ultrasound waveform produced by an ultrasound transmitter.
Figure 6:
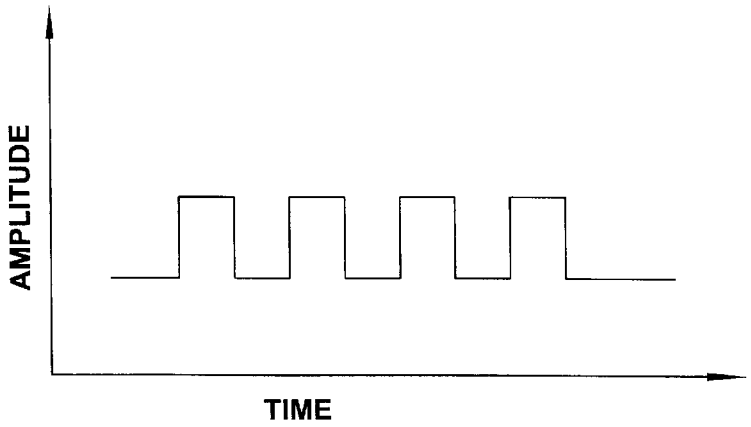
FIG. 6 is a graphical representation of even another exemplary embodiment of an ultrasound waveform produced by an ultrasound transmitter.

The ultrasound transmitter 220 generates and transmits an ultrasound waveform to the cooktop surface 110. In one embodiment shown in FIGS. 4 and 5, the ultrasound waveform can comprise a single impulse. In another embodiment, the ultrasound waveform can comprise a plurality of impulses and/or an impulse train. In even another embodiment, the ultrasound waveform can comprise a continuous wave ultrasound transmission. It should be appreciated that the ultrasound waveforms shown in FIGS. 4–6 are exemplary embodiment, and the ultrasound waveform can include shapes other than those shown. The ultrasound waveform generated by the ultrasound transmitter 220 and transmitted to the cooktop surface 110 produces an excitation in the cooktop surface 110. The excitation produces a resultant ultrasound waveform in the cooktop surface 110. The resultant ultrasound waveform corresponds to at least one property of the cooktop 100.

The ultrasound receiver 210 also contacts the cooktop surface 110 and receives the resultant ultrasound waveform. The ultrasound receiver 210 produces a receiver output in response to the resultant ultrasound waveform, and the receiver output corresponds to the resultant ultrasound waveform and also the at least one property of the cooktop 100. As shown in FIG. 1, the ultrasound transducer 150, including the ultrasound transmitter 220 and the ultrasound receiver 210, is connected to the processor 160. In another embodiment, as shown in FIG. 2, the ultrasound transmitter 220 and the ultrasound receiver 210 are each individually connected to the processor 160. In even another embodiment, as shown in FIG. 3, the ultrasound transducer 150 including the ultrasound transmitter 220 and the ultrasound receiver 210 are connected to a filter 310 that receives and filters the receiver output. The filter 310 can comprise, for example, a low pass filter, a high pass filter or a band pass filter. The filter 310 is connected to signal conditioner 320 that conditions the receiver output. In one embodiment, the signal conditioner can form the receiver output into a square wave signal that corresponds to the resultant ultrasound waveform received from the cooktop surface. The signal conditioner 320 is connected to the processor 160 that interprets and/or analyzes the receiver output and determines the at least one property of the cooktop from the analysis of the receiver output. In one embodiment, the processor 160 performs a frequency analysis of the receiver output. It should be appreciated that frequency analysis of the receiver output includes, for example, bandwidth estimation of the receiver output that corresponds to the resultant ultrasound waveform. It should also be appreciated that the processor 160 can perform other analysis of the receiver output, such as, for example, impedance analysis and/or doppler analysis. As shown in FIGS. 1–3, the processor 160 is connected to the controller 140, and the processor 160 supplies a processor output to the controller 140 that corresponds to the at least one property of the cooktop 100. It should be also appreciated that the ultrasound transmitter 210 and the ultrasound receiver can each individually or as part of the ultrasound transducer 150 be connected to the filter 310, the signal conditioner 320, the processor 160 and the controller 140.

In one embodiment, the at least one property of the cooktop 100 includes properties of the vessel 120 and properties relating to the movement and/or placement of the vessel 120. The vessel properties can comprise vessel size, vessel type, and vessel state. The vessel size can comprise the relative size, for example, small or large, among commonly used vessels 120. The vessel type can refer to purpose of which the vessel 120 is used. The vessel state can comprise, for example, vessel absence from the cooktop surface 110, vessel presence on the cooktop surface 110. The relationship between the vessel absence and the vessel presence indicates that the vessel 120 is in either a presence state or an absence state with respect the cooktop surface 110. In addition, the vessel 120 can be transitioning between the presence state and absence state. The transitioning of the vessel 120 comprises, for example, either placement of vessel 120 on the cooktop 110 or removal of the vessel 120 from the cooktop 110.

A vessel 120 that is positioned on the cooktop surface 110 will create a material interface between the bottom of the vessel 120 and the cooktop surface 110. If the ultrasound transmitter 220 transmits an ultrasound waveform, as shown in FIGS. 4–6, the vessel presence or absence property of vessel can be determined by analysis of the resultant ultrasound waveform. In one embodiment, the analysis of the resultant ultrasound waveform includes comparing the resultant ultrasound waveform to a reference waveform, and the reference waveform can be obtained via a calibration of the cooktop 100 during manufacturing or installation of the cooktop 100. The transition of the vessel 120 between placement and removal can be detected by having the ultrasound transmitter 220 transmit the ultrasound on a periodic basis and continually analyzing the resultant ultrasound waveform.

The detection of the size or type of the vessel 120 can be used to control the size of the energy source 130 that is used to heat the vessel 120, and thus decrease the amount of time required to heat the vessel 120. In one embodiment, the energy source 130 comprises a burner having an inner burner and an annular burner. For a vessel 120 covering a small amount of cooktop surface area, the inner burner can be used to heat the vessel 120. For vessels 120 covering a large amount of cooktop surface area, the inner burner and the annular burner can be used to heat the vessel 120. In exemplary embodiment embodiment, after the presence of the vessel 120 on the cooktop surface 110 has been determined, the ultrasonic transmitter 220 transmits an ultrasound waveform to the cooktop surface 120. The ultrasound waveform comprises, such as, for example, the ultrasound waveforms shown in FIGS. 4–5. The ultrasound receiver 210 receives a resultant ultrasound waveform from the excitation created by the ultrasound waveform supplied by the ultrasound transmitter 220. The ultrasound receiver 210 produces a receiver output corresponding to the resultant ultrasound waveform. The processor 160 receives the receiver output and performs an analysis of the receiver output. The analysis comprises an impedance analysis and a frequency analysis of the receiver output to determine the impedance of the interface between the vessel 120 and the cooktop surface 110 as a function of the frequency. Further, the processor 160 has a plurality of ultrasound vessel signatures stored in a memory storage device, such as, for example, random access memory, read-only memory, flash memory or a hard disk drive. The processor 160 compares the analysis of the receiver output to each of the plurality of ultrasound vessel signatures. From this comparison, the processor 160 classifies size and/or type of vessel 120 and supplies a processor output to the controller 140 that corresponds to the classification, and the controller 140 controls operation of the cooktop 100 based, in part, on the processor output. It should be appreciated that the plurality of ultrasound vessel signatures can be predetermined and included in a memory device of the processor 160. It should also be determined that the plurality of ultrasound vessel signatures can be determined during a calibration of the cooktop 100 during manufacturing and/or installation of the cooktop 100.

In another embodiment, the at least one properties of the cooktop can comprise properties relating to the boil state of contents 170 of the vessel 120. The boil state of the contents 170 can comprise, for example, the determination of whether the contents 170 is boiling, contents of the vessel 120, mass of the contents of the vessel 120 and other characteristics. The boil state of the contents 170 of the vessel 120 can also be determined using the ultrasound transducer 150 including the ultrasound transmitter 220 and the ultrasound receiver 210. In one embodiment, the boil state of the contents 170 can be determined by the ultrasound transmitter 220 transmitting an ultrasound waveform to the cooktop surface 110. In one embodiment, the ultrasound waveform comprises, for example, the ultrasound waveform shown in FIG. 6. In another embodiment, the ultrasound waveform can comprise a continuous wave ultrasound transmission. From these types of ultrasound waveforms, the resultant ultrasound waveform will be modulated by vibration of the vessel 120. Accordingly, the ultrasound receiver 210 will receive the resultant ultrasound waveform and supplies a receiver output that corresponds to the resultant ultrasound waveform that has been modulated by the vibration of the vessel 120. The processor 160 receives and can analyze the receiver output to determine the boil state. In one embodiment, the modulated resultant ultrasound waveform from the receiver output can be downcoverted to a baseband for further processing. The baseband information can then be used to determine the boil state of the contents 170 of the vessel 120. In one embodiment, the baseband information resulting from the a continuous wave transmission is analyzed to estimate the bandwidth using a signal processing technique, such as, for example, spectral analysis. The bandwidth information is examined over a predetermined amount of time and changes in the bandwidth can be used to detect, for example, the onset of the boil state. In another embodiment, the baseband information can be compared to a plurality of stored basebands that are stored in a memory storage device in the processor 160. It should be appreciated that the memory storage device can comprise, such as, for example, random access memory, read-only memory, flash memory or a hard disk drive. Once the processor 160 has determined the boil state from the analysis, the processor 160 produces a processor output corresponding to the boil state and supplied the processor output to the controller 140 that controls operation of the cooktop 100 based, in part, on the processor output. It should be appreciated that the plurality of stored basebands can be predetermined and included in a memory device of the processor 160. It should also be determined that the plurality of stored basebands can be determined during a calibration of the cooktop 100 during manufacturing and/or installation of the cooktop 100.

The foregoing discussion of the invention has been presented for purposes of illustration and description. Further, the description is not intended to limit the invention to the form disclosed herein. Consequently, variations and modifications commensurate with the above teachings and with the skill and knowledge of the relevant art are within the scope of the present invention. The embodiment described herein above is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. An apparatus for determining at least one property of a cooktop having a cooktop surface and a vessel selectively positioned on the cooktop surface, the apparatus comprising:

an ultrasound transducer contacting the cooktop surface, the ultrasound transducer comprising:

an ultrasound transmitter contacting the cooktop surface and providing an ultrasound waveform to the cooktop surface creating an excitation in the cooktop surface; and an ultrasound receiver contacting the cooktop surface, the ultrasound receiver receiving a resultant ultrasound waveform in response to the excitation and producing a receiver output signal in response to the resultant ultrasound waveform;

a processor connected to the ultrasound transducer, the processor receiving the receiver output signal and producing a processor output signal corresponding to the at least one property of the cooktop.

2. The apparatus of claim 1 wherein the ultrasound transmitter contacts the cooktop surface at a first location and the ultrasound receiver contacts the cooktop surface at a second location wherein the first location is different from the second location.

3. The apparatus of claim 1 wherein the ultrasound waveform comprises a single impulse.

4. The apparatus of claim 1 wherein the ultrasound waveform comprises a plurality of impulses.

5. The apparatus of claim 1 wherein the ultrasound waveform comprises a continuous wave ultrasound transmission.

6. The apparatus of claim 1 wherein the cooktop surface comprises a top and a bottom, the vessel being selectively positioned on the top of the cooktop surface and the ultrasound transducer being positioned on the bottom of the cooktop surface.

7. The apparatus of claim 1 wherein a filter is connected between the ultrasound transducer and the processor for filtering the receiver output signal received from the ultrasound receiver.

8. The apparatus of claim 1 wherein the processor comprises a signal processor for processing the receiver output signal.

9. The apparatus of claim 8 wherein the signal processor performs doppler analysis on the receiver output signal and produces the processor output signal based on the doppler analysis.

10. The apparatus of claim 8 wherein the signal processor performs a frequency analysis on the receiver output signal and produces the processor output signal based on the frequency analysis.

11. The apparatus of claim 1 wherein the at least one property of the cooktop is selected from the group consisting of vessel type, vessel presence and a boil state of the contents of the vessel.

12. The apparatus of claim 1 wherein the cooktop surface comprises a glass-ceramic material.

13. An apparatus for determining at least one property of a cooktop having a cooktop surface with a top and bottom and a vessel selectively positioned on the top of the cooktop surface, the apparatus comprising:

an ultrasound transmitter contacting the bottom of the cooktop surface at a first position and transmitting an ultrasound waveform within the cooktop surface creating an excitation in the cooktop surface;

an ultrasound receiver contacting the bottom of the cooktop surface at a second position wherein the first position is different from the second position, the ultrasound receiver receiving a resultant ultrasound waveform in response to the ultrasound waveform produced by the ultrasound transmitter and the ultrasound receiver producing a receiver output signal based on the resultant ultrasound waveform; and a processor connected to the ultrasound receiver for receiving the receiver output signal and producing a processor output signal in response to the receiver output signal, the processor output signal being indicative of the at least one property of the cooktop.

14. The apparatus of claim 13 wherein the processor is connected to the ultrasound transmitter for instructing the ultrasound transmitter to transmit the ultrasound waveform.

15. The apparatus of claim 13 wherein the ultrasound waveform comprises a single impulse.

16. The apparatus of claim 13 wherein the ultrasound waveform comprises a plurality of impulses.

17. The apparatus of claim 13 wherein the ultrasound waveform comprises a continuous wave ultrasound transmission.

18. The apparatus of claim 13 wherein a filter is connected between the ultrasound receiver and the processor for filtering the receiver output signal received from the ultrasound receiver.

19. The apparatus of claim 13 wherein the processor comprises a signal processor for processing the receiver output signal.

20. The apparatus of claim 19 wherein the signal processor performs doppler analysis on the receiver output signal and produces the processor output signal based on the doppler analysis.

21. The apparatus of claim 19 wherein the signal processor performs a frequency analysis on the receiver output signal and produces the processor output signal based on the frequency analysis.

22. The apparatus of claim 13 wherein the at least one property of the cooktop is selected from the group consisting of vessel type, vessel presence and a boil state of the contents of the vessel.

23. The apparatus of claim 13 wherein the cooktop surface comprises a glass-ceramic material.

24. The apparatus of claim 13 wherein the ultrasound waveform comprises a sinusoidal wave.

25. A method for determining at least one property of a cooktop having a cooktop surface and a vessel selectively positioned on the cooktop surface, the method comprising the steps of:

contacting a transducer to the cooktop surface;

providing an ultrasound waveform to the cooktop surface from a transmitter of the transducer;

creating an excitation in the cooktop surface from the provided ultrasound waveform;

receiving a resultant ultrasound waveform using a receiver of the transducer, the resultant ultrasound waveform being in response to the excitation;

producing a receiver output signal in response to the resultant ultrasound waveform; and determining a processor output signal based on the receiver output wherein the processor output signal corresponds to the at least one property of the cooktop.

26. The method of claim 25 further comprising the step of filtering the resultant ultrasound waveform.

27. The method of claim 25 further comprising the step of signal processing the resultant ultrasound waveform.

28. A method for determining at least one property of a cooktop having a cooktop surface with a top and bottom and a vessel selectively positioned on the top of the cooktop surface, the method comprising the steps of:

contacting an ultrasound transmitter to the bottom of the cooktop surface at a first position;

transmitting an ultrasound waveform to the cooktop surface from the transducer;

creating an excitation in the cooktop surface from the provided ultrasound waveform;

contacting an ultrasound receiver to the bottom of the cooktop surface at a second position, the first position being different from the second position;

receiving a resultant ultrasound waveform using the ultrasound receiver, the resultant ultrasound waveform being in response to the excitation;

producing a receiver output signal in response to the resultant ultrasound waveform; and determining a processor output signal based on the receiver output wherein the processor output signal corresponds to the at least one property of the cooktop.

29. The method of claim 28 further comprising the step of filtering the resultant ultrasound waveform.

30. The method of claim 28 further comprising the step of signal processing the resultant ultrasound waveform.

* * * * *